US006957781B2

(12) United States Patent
Gowens et al.

(10) Patent No.: US 6,957,781 B2
(45) Date of Patent: Oct. 25, 2005

(54) CLEANING ATTACHMENT FOR FLUID DISPENSER NOZZLES AND FLUID DISPENSERS USING SAME

(75) Inventors: Patrick A. Gowens, Libertyville, IL (US); Ryan Aafedt, Idaho Falls, ID (US)

(73) Assignee: Kraft Food Holdings, Inc., Northfield, IL (US)

( * ) Notice: Subject to any disclaimer, the term of this patent is extended or adjusted under 35 U.S.C. 154(b) by 101 days.

(21) Appl. No.: 10/661,544

(22) Filed: Sep. 15, 2003

(65) Prior Publication Data

US 2005/0056707 A1 Mar. 17, 2005

(51) Int. Cl.[7] ..... B05B 15/02; F23D 11/34; F23D 11/38; F23D 14/50

(52) U.S. Cl. ..... 239/112; 222/145; 222/148; 239/113

(58) Field of Search ..... 239/112, 600, 104; 222/148, 571, 145

(56) References Cited

U.S. PATENT DOCUMENTS 3,926,229 A 12/1975 Scholle
4,350,187 A 9/1982 Trusselle et al.
4,360,129 A * 11/1982 Brokaw et al. ..... 222/146.2
4,969,602 A * 11/1990 Scholl ..... 239/298
4,970,985 A * 11/1990 Slautterback ..... 118/300
5,025,887 A * 6/1991 Jamison ..... 181/187
5,226,565 A 7/1993 Hladis et al.
5,226,863 A * 7/1993 Kimura ..... 141/8
5,266,565 A * 11/1993 Lacoste et al. ..... 514/114
5,309,958 A 5/1994 Ueda et al.
5,447,254 A * 9/1995 Hoover et al. ..... 222/1

FOREIGN PATENT DOCUMENTS

JP 04-102503 A 4/1992
JP 08-182950 A 7/1996

* cited by examiner

*Primary Examiner*—David A. Scherbel
*Assistant Examiner*—James S. Hogan
(74) *Attorney, Agent, or Firm*—Fitch Even Tabin & Flannery

(57) ABSTRACT

A nozzle attachment for removing residual material retained on the dispensing nozzle of a fluid dispenser, having a retainer adapted to releasably attach the nozzle attachment to a dispensing nozzle, and a pair of hollow-bodied nozzle attachment components that define, when nested together, an intervening space useful as a gas passageway for pressurized gaseous fluid introduced and directed to a discharge opening at a lower axial end of the nested nozzle attachment components. The gas passageway is adapted to emit gas introduced into the gas passageway as a gas stream in a manner effective to remove residual material clinging to the nozzle. Dispensers using the nozzle attachment are presented, including one using a truncated valve head.

33 Claims, 6 Drawing Sheets

CLEANING ATTACHMENT FOR FLUID DISPENSER NOZZLES AND FLUID DISPENSERS USING SAME

FIELD OF THE INVENTION

The present invention generally relates to a nozzle attachment for removing residual material retained on the dispensing nozzle of a fluid dispenser by a gas flow at a discharge nozzle during intermittent fluid dispensing operations involving opening and shutting off of a fluid dispenser. The gas flow creates a shearing force at the discharge end of the nozzle that dislodges and blows off any residual material clinging to the discharge end after a prior dispensing operation or cycle.

BACKGROUND OF THE INVENTION

Positive flow cut off of a filling apparatus is difficult to achieve in sanitary valves, especially when viscous fluids are being dispensed which have a tendency to leave tailings that cling to the dispenser nozzle after a dispensing cycle. For example, when running hot process cheese at 160 to 180 degrees Fahrenheit, it is difficult to achieve positive flow cutoff in a filling apparatus using conventional sanitary filling valves. Upon full closure of a dispensing valve, residual cheese tends to adhere to external valve surfaces. This retention can lead to unacceptable variability in weight control for the packaged cheese. In addition, the residue can become dislodged at a later time, and possibly drip or otherwise drop onto an underlying conveyor belt or other surfaces. Removal of the drip or tailing residues from the nozzle by mechanical or manual means is generally difficult or overly burdensome in practice.

The prior art reflects a number of different approaches to preventing build-up of residue of dispensed material on dispenser nozzles. U.S. Pat. Nos. 5,309,958; 4,970,985; 4,350,187; 3,926,229, and Japanese published appln. nos. all generally describe a dispensing apparatus including means for removing tailings and the like by which air or a gas is blown out of a hole or array of gas passageways provided in the dispensing head itself. However, these approaches require fundamental design changes in the dispenser head or filling valve construction. It would be highly desirable to solve the tailings problem in a manner which can be implemented on existing dispensing head equipment with little modification or retrofitting required on the dispenser head, especially with respect to the wetted parts of the dispenser head.

U.S. Pat. Nos. 5,226,565 and 5,447,254 describe nozzle attachments or fittings for dispensers for use in nozzle cleaning or shut-off drip protection. Both patents provide air passageways that direct air at the discharge end of a nozzle in which the air passageway is partly defined by dispenser head components and not the nozzle attachment exclusively. The attachment of the nozzle attachment and detachment requires the use of tools and the attachment uses wetted parts of the nozzle in the blow off operation.

A need still exists for fluid dispenser arrangements that will ensure that residual material is cleaned off of dispenser nozzles as part of each dispensing cycle so that the amount of food dispensed from one filling cycle to the next does not vary. Further, there is a need for a solution to the nozzle clinging/dripping problem that does not require fundamental design changes in the dispensers.

SUMMARY OF THE INVENTION

This invention provides an improved nozzle attachment for removing residual material from the discharge ends of dispenser nozzles used for dispensing flowable materials. The invention also provides a dispenser incorporating the improved nozzle attachment and methods of their use in filling procedures. According to an embodiment, the nozzle attachment of this invention is an assembly of a relatively small number of discrete parts that can be readily assembled into a unified component for installation on a nozzle, and which also can be easily dismantled into its individual parts for inspection and cleaning-out-of-place or manual cleaning. Therefore, in one aspect, the nozzle attachment is conveniently used for sanitary dispensing applications, although not limited thereto. In one aspect, no tools are required to couple the nozzle attachment to a nozzle nor are they needed to dismantle it for inspection and cleaning, as the device can be assembled and disassembled completely by hand.

In accordance with an embodiment, the nozzle attachment provides the gaseous hydrodynamic system used to create the "blow off" force and effect on nozzle residue, and the fluid dispenser head is not modified to support that function other than providing a suitable mounting surface thereon for the nozzle attachment. Therefore, the nozzle attachment can be easily used on many different types of fluid dispensing heads. It is preferred to provide a nozzle attachment that can be readily attached or detached from a nozzle to facilitate full inspection and/or cleaning without the need for tools to disconnect or to disassemble the nozzle attachment for cleaning. To this end, in one embodiment a quick connect and disconnect device that is operable manually without the need to use tools to attach and detach the nozzle attachment to the nozzle. In one aspect, the quick connect and disconnect device comprises a clamping retainer for clamping the attachment to an attaching portion of the dispensing nozzle without the use of a tool. Preferably, a split ring clamping retainer is used and threaded members including wing nuts are manually threaded to tighten or loosen the clamping force.

In an embodiment, the nozzle attachment includes a retainer by which it is releasably attachable to a dispensing nozzle, and a pair of hollow-bodied nozzle attachment components that define, when nested together, an intervening space that serves as a gas passageway in-between them into which pressurized gaseous fluid can be introduced. The introduced pressurized gas flows into the gas passageway and from there is directed to a discharge opening thereof provided at a lower axial end of the nested nozzle attachment components. The gas passageway present in the assembled nozzle attachment is adapted to emit a gas stream at an inward and downward angle relative to a discharge end of the dispensing nozzle effective to create a shearing force at the discharge end of the nozzle that dislodges and removes any residual material clinging to the discharge end after a prior dispensing operation or cycle. This ensures that residual material is cleaned off of the dispenser nozzles as part of each dispensing cycle so that the amount of food dispensed from one filling cycle to the next does not vary.

The nozzle attachment of this invention is generally applicable to dispenser nozzle arrangements used to dispense viscous fluid materials. These viscous fluid materials include edible materials and foods that can be processed in a flowable state, such as process cheese, dairy cream, mayonnaise, meats, peanut butter, and so forth. The nozzle attachment is especially well-suited for nozzled fluid dispensers used to dispense higher viscosity or tackier fluid food products having a greater tendency to cling to dispensing nozzles, although it also can be used to advantage with fluid dispensers used for other types of fluids having those attributes. These other types of viscous materials can include polymeric compositions, plastic compositions, hot melt adhesives, and so forth.

In one embodiment, the nozzle attachment includes an outer nozzle attachment component comprising a cylindrical portion having an inner surface with an inner diameter, and a flanged surface extending radially outward at one axial end thereof and an inward-facing beveled surface at the other axial end thereof, and further including an air inlet adapted to receive pressurized gas through the cylindrical portion. It also includes an inner nozzle attachment component including a cylindrical portion having an outer surface with an outer diameter that is smaller than the inner diameter of the outer nozzle attachment component. The inner attachment component has a collar extending radially outward at one axial end thereof, and an outward-facing beveled surface at the other axial end thereof. The inner nozzle attachment component is adapted to be nested within the outer nozzle attachment component by positioning of its collar on the flanged surface of the outer nozzle attachment component. When nested, an internal upper gas passageway is defined between the outer surface of the inner nozzle attachment component and the inner surface of the outer nozzle attachment component that is in communication with the gas inlet of the outer nozzle attachment component. The nozzle attachment includes a retainer adapted to releasably retain the outer nozzle attachment component on the nozzle while the inner nozzle attachment component is nested therein.

This nesting configuration of the two components also defines a lower gas passageway having a gas discharge opening that is defined between the outward-facing beveled surface of the inner nozzle attachment component and the inward-facing beveled surface of the outer nozzle attachment component. The lower gas passageway is in fluid communication with the upper gas passageway. The lower gas passageway is adapted by its configuration to direct pressurized gas at an inward and downward angle at the discharge end of the nozzle. The gas emitted by the nozzle attachment at the discharge opening creates a shearing force at the discharge end of the nozzle that will dislodge and remove any residual material clinging to the discharge end after the most recent dispensing operation. This ensures all product dispensed per dispensing cycle gets packaged in that cycle, and that uniform amounts of food are dispensed in each dispensing cycle. Herein, the nested components are easily assembled or disassembled by moving the nested inner component axially relative to the outer component. This allows quick separation for cleaning and re-assembly after cleaning.

In another embodiment, there is a fluid dispenser for use in intermittent dispensing operations that incorporates the nozzle attachment described herein. The dispenser includes a dispenser body having a fluid inlet communicating with a fluid passageway, and the discharge nozzle having the discharge end from which fluid is dispensed. There is a valve stem positioned within the fluid passageway adapted to be controllably moved vertically up and down within the fluid passageway by an actuator. A valve head is located in the discharge end of the discharge nozzle. The nozzle attachment is used after each dispensing cycle to eliminate residue clinging from the discharge end of the nozzle.

In one preferred embodiment, the dispenser valve head has a truncated cone shape having increasing diameter axially nearer the discharge end of the nozzle and smaller diameter axially further from the discharge end of the nozzle. The truncated-cone shaped valve head has a first diameter adapted to seal with the discharge passageway of the nozzle to stop fluid flow out of the discharge end of the nozzle when the valve stem is sufficiently vertically upraised, and a second diameter, smaller than the first diameter, in which a gap is provided between the second diameter and inner walls of the discharge passageway of the nozzle when the valve stem is sufficiently vertically lowered, to permit flow of fluid out of the discharge end of the nozzle until the valve stem is raised again.

For purposes herein, the term "fluid" means materials in a wet flowable condition, including liquids, slurries, emulsions, pastes, creams, hot melts, and so forth. The term "gas" can mean dry gases, and vapors, such as steam. The term "manual cleaning" means total disassembly for cleaning and inspection. "Clean-out-of-place" or "COP" means a part can be partially dissembled and cleaned, such as in specialized COP pressure tanks. "Clean-in-Place" or "CIP" means no disassembly or partial disassembly is required to clean a part. "Sanitize" or "sanitary" and the like refers to the reduction of microorganisms to levels considered safe from a public health standpoint. "Sterilize" or "sterile" and the like refers to the statistical destruction and removal of all living organisms.

BRIEF DESCRIPTION OF THE DRAWING

Other features and advantages of the present invention will become apparent from the following detail description of preferred embodiments of the invention with reference to the drawings, in which.

The features depicted in the figures are not necessarily drawn to scale. Similarly numbered elements in different figures represent similar components unless indicated otherwise. Elements and dimensions in the figures are not necessarily drawn to scale.

DETAILED DESCRIPTION OF THE INVENTION

Figure 1:
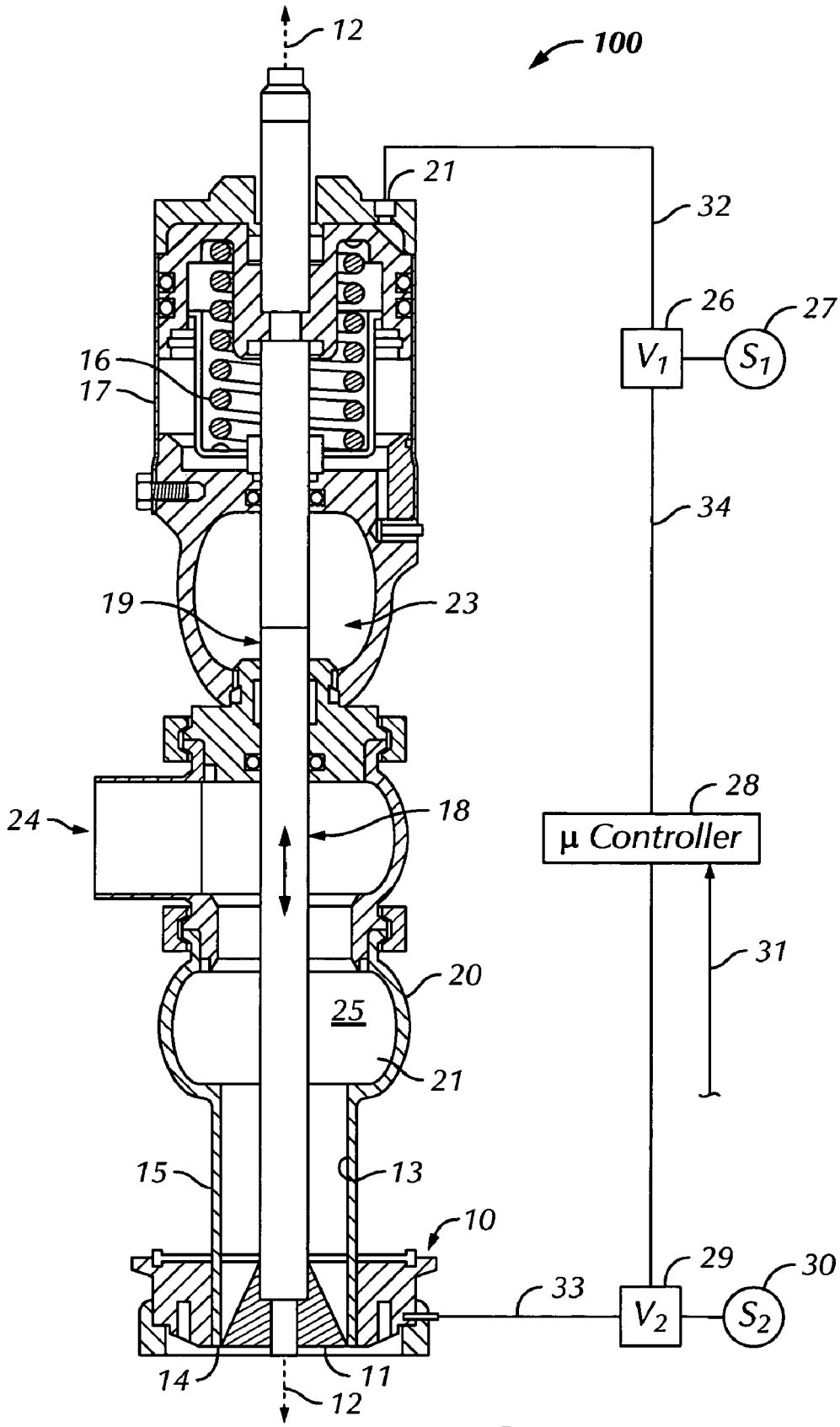
FIG. 1 shows a cross-sectional view of a fluid dispenser having a nozzle attachment releasably connected to it according to an embodiment of the invention, in which the valve head is in a sealed/closed position.

Referring to FIG. 1, a fluid dispenser 100 having a nozzle attachment 10 according to an embodiment of the invention is illustrated. A general overview of the manner in which the dispenser 100 functions is provided as follows. Axial movement of the valve head 11 up or down in the vertical direction to operate the dispenser 100 occurs in the following manner. For purposes of the descriptions herein, references to an axial direction means parallel to the direction of the centerline 12 of the dispenser 100, while a radial direction will be perpendicular thereto.

The valve head 11 is normally maintained in a closed position in which it is seated against the inner walls 13 of the discharge end 14 of the nozzle 15 in a sealing relationship. The dimensions of the valve head 11 and inner walls 13 at the discharge end 14 of the nozzle 15 are machined to have very close tolerances so that an essentially gap-free seal is made between the valve head 11 and the inner walls 13 of the valve head 11, so that leakage is minimized during nondispensing times of operation.

In this non-limiting illustration, a biasing means, such as a return spring 16 located in an actuator 17, is used to keep the valve head 11 normally in the closed position. The valve head 11 is connected to the actuator 17 via a valve stem 18. The valve stem 18 can be vertically reciprocated by the actuator 17, as indicated by the double-arrow in FIG. 1. The valve stem 18 can be releasably attached, e.g., by threading or other mechanical connection means 19, to the actuator 17, so that the valve stem 18 can be detached for inspection and cleaning without need to disassemble the actuator 17.

In order to move the valve head 11 to an open position and permit flow of fluid out of the dispenser 100, pressurized air is introduced into a cavity 21 in the actuator 17 via a port 21 by way of an air line 32 connected to a supply source of pressurized air 27 ("$S_1$"). The flow or pressurized air through line 32 is preferably controlled via valve 26 ("$V_1$"), which is operated by a controller 28, such as a microprocessor-based controller, via a communication line 34. The controller 28 can be interfaced and programmed via communication line 31. Radio frequency signal control techniques and the like also could be used.

Figure 2:
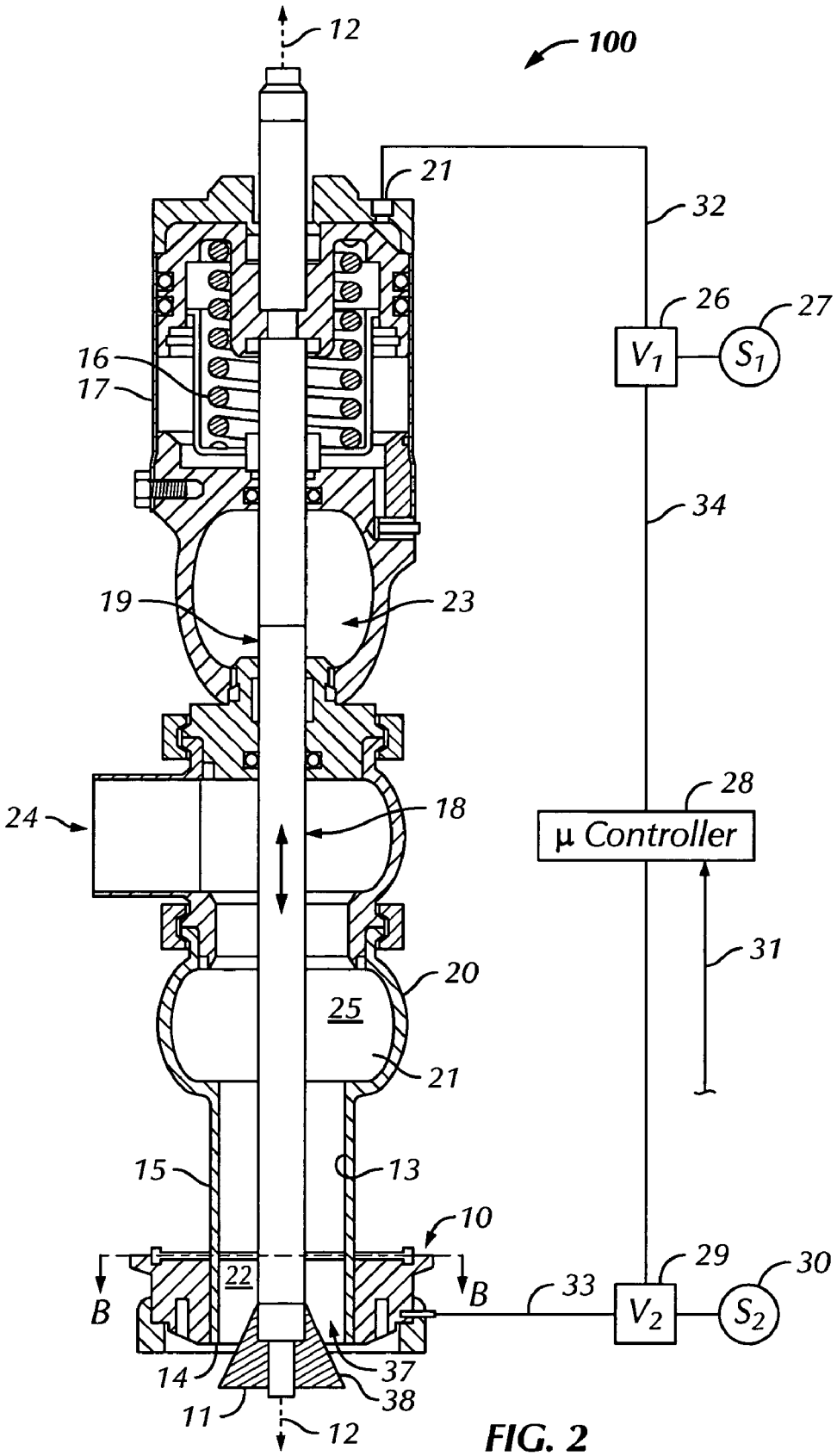
FIG. 2 shows the fluid dispenser and nozzle attachment according of FIG. 1, in which the valve head is in an open position.

Referring to FIG. 2, the pressurized air fed through line 32 is provided in sufficient force to overcome the biasing force of the spring 16 and causes the actuator 17 to move the valve stem 18 vertically downward. This downward movement of the valve stem 18 unseats the valve head 11 as the larger diameter portion of the valve head 11 clears the bottom of the discharge end 14 of the nozzle 15 and a smaller diameter portion of the valve head 11 has clearance between it and the inner walls 13 of the nozzle 15 through which fluid fed through inlet 24 and passing down through passageway 25 defined inside the valve body 20 can then exit the dispenser 100 through nozzle 15.

In one preferred embodiment, the valve head 11 has a truncated cone-shaped body. The valve head 11 tapers inward in the upward axial direction. The valve head makes a tight seal with inner walls 13 of the nozzle 15. As illustrated in FIG. 2, when the valve stem 18 is moved downward, it pushes the valve head 11 at least partially out of the discharge end 14 of the discharge passageway 22. Because of the tapering external profile of the valve head 11, a circumferential gap 37 will be created between the exterior surface of the valve head 38 and the inner walls 13 of the discharge passageway 22. The fluid can then flow through the gap created and out of the discharge passageway 22 at the discharge end 14 of nozzle 15.

After a desired amount of fluid is discharged from the dispenser 100, the valve head 11 is returned to its closed, seated position within the nozzle 15. In this illustration, the valve 26 is closed by the controller 28 and pressurized air in line 32 can be bled off at valve 26. Upon doing this, biasing action of the return spring 16 pulls the valve stem 18 vertically upward until the valve head 11 seats again in sealing relationship inside the discharge end 14 of the nozzle 15.

In this non-limiting illustration, the fluid dispenser involves a single seat, shut-off valve system with positive control. It will be appreciated that the actuator 17 alternatively could be a manual actuator as used to control up and down vertical movement of the valve head 11. The actuator 17 itself basically can incorporate features and functions used in such mechanisms in conventional filling valves. The open yoke feature 23 shown in FIG. 1 is generally known in filling valves and is typically used to reveal the valve stem position and prevent product from entering the actuator 17. These types of pneumatic filling valves also typically include bearings and sealing O-rings, and so forth, used to support their actuation functionality that are generally conventional in nature, which do not by themselves form part of this invention, so they are not discussed in detail here to simplify the discussion. Persons of skill will appreciate how to employ those types of filing valve features in the context of the present disclosure.

While the valve head 11 is in the closed position and before initiating the next dispensing cycle, a nozzle attachment 10 according to an embodiment of the invention is employed to eliminate any residue of dispensed fluid left clinging to the discharge end 14 of nozzle 15. The nozzle attachment 10 is releasably attached to the nozzle 15, preferably prior to initiating the dispensing operation.

Figure 3:
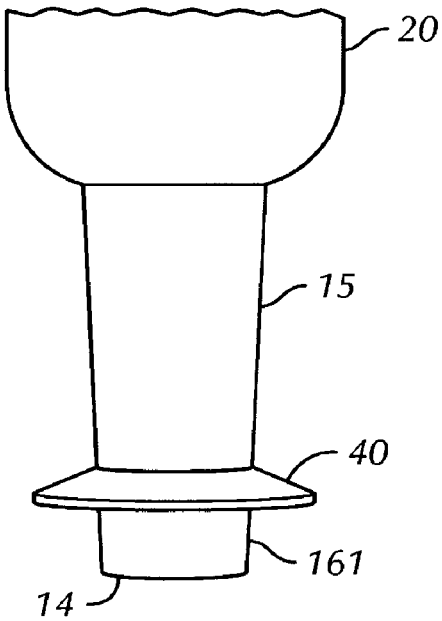
FIG. 3 is an enlarged perspective view of the nozzle of the dispenser of FIG. 1 without the nozzle attachment.

As shown in FIG. 3, in this non-limiting illustration, the nozzle 15 is fabricated to include an integral skirt 40, i.e., a narrow protuberance that circumscribes an outer surface area of the nozzle 15, to which the nozzle attachment 10 can be releasably mechanically connected. The skirt 40 is located near and axially above the discharge end 14 of the nozzle 15. The discharge end 14 has an outer surface circumferential surface 161.

Figure 4:
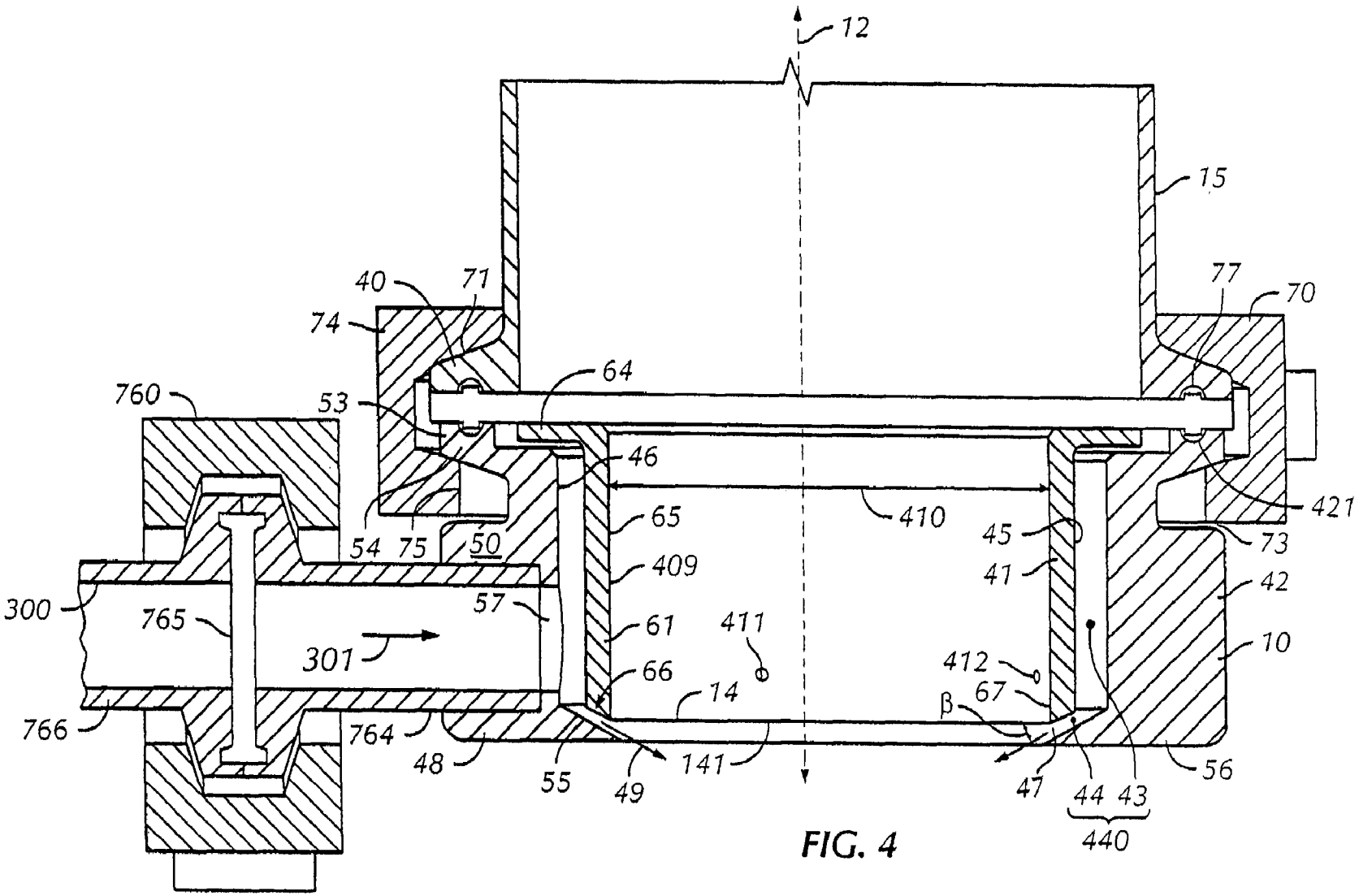
FIG. 4 is an enlarged cross-sectional view of the nozzle attachment coupled to the nozzle of the dispenser of FIG. 1, which is taken along section A—A indicated in FIG. 5.

As shown in FIG. 4, the nozzle attachment 10 is a nozzle fitting that can be releasably coupled to the nozzle 15 via the skirt 40. In general, the nozzle attachment 10 includes an assembly of separate discrete parts or components that are assembled together to form an annular-shaped fitting, which is fitted circumferentially around and mechanically coupled in place to the nozzle 15 with a retainer 70. The nozzle attachment 10 includes an inner nozzle attachment component 41 that nests inside an outer nozzle attachment component 42 in a coaxially aligned manner defining gas passageways 43 and 44 between the outer surface 45 of the inner nozzle attachment component 41 and the inner surface 46 of the outer nozzle attachment component 42. The inner nozzle attachment 41 has an inner surface 409 having an inner radial diameter 410 that is large enough to slip over and concentrically surround the nozzle 15 at its discharge end 14 in a spaced relationship with respect to the outer surface 161 of the discharge end 14 of nozzle 15 where located below the skirt 40.

Pressurized gas fed into the gas passageway 440 comprised of fluidly communicating gas passageways 43 and 44 in the nozzle attachment 10 are emitted from a discharge opening 47 at the lower axial end 48 of the nozzle attachment 10. This emitted gas 49 has a trajectory making an angle β (beta) with the horizontal plane 141 of the discharge end 14 of the nozzle 15. The horizontal plane 141 of the discharge end 14 extends generally perpendicular to axial direction 12. The force associated with the stream of pressurized gas 49 exiting the nozzle attachment 10 is effectively used to blow food residues off the discharge end 14 of the nozzle 15 by action of shearing forces.

The retainer 70 includes an internal circumferential groove 71 that is dimensioned to conformably receive the nozzle skirt 40 under an upper protrusion 74 of the retainer 70, while concurrently receiving a flanged portion 53 of the outer nozzle attachment component 42 in a conforming manner above a lower protrusion 75 of the retainer 70. The outer nozzle attachment component 42 includes a circumferential groove 73 immediately below its flanged portion 72, which conformably receives the lower protrusion 75 of the retainer 70.

Figure 6:
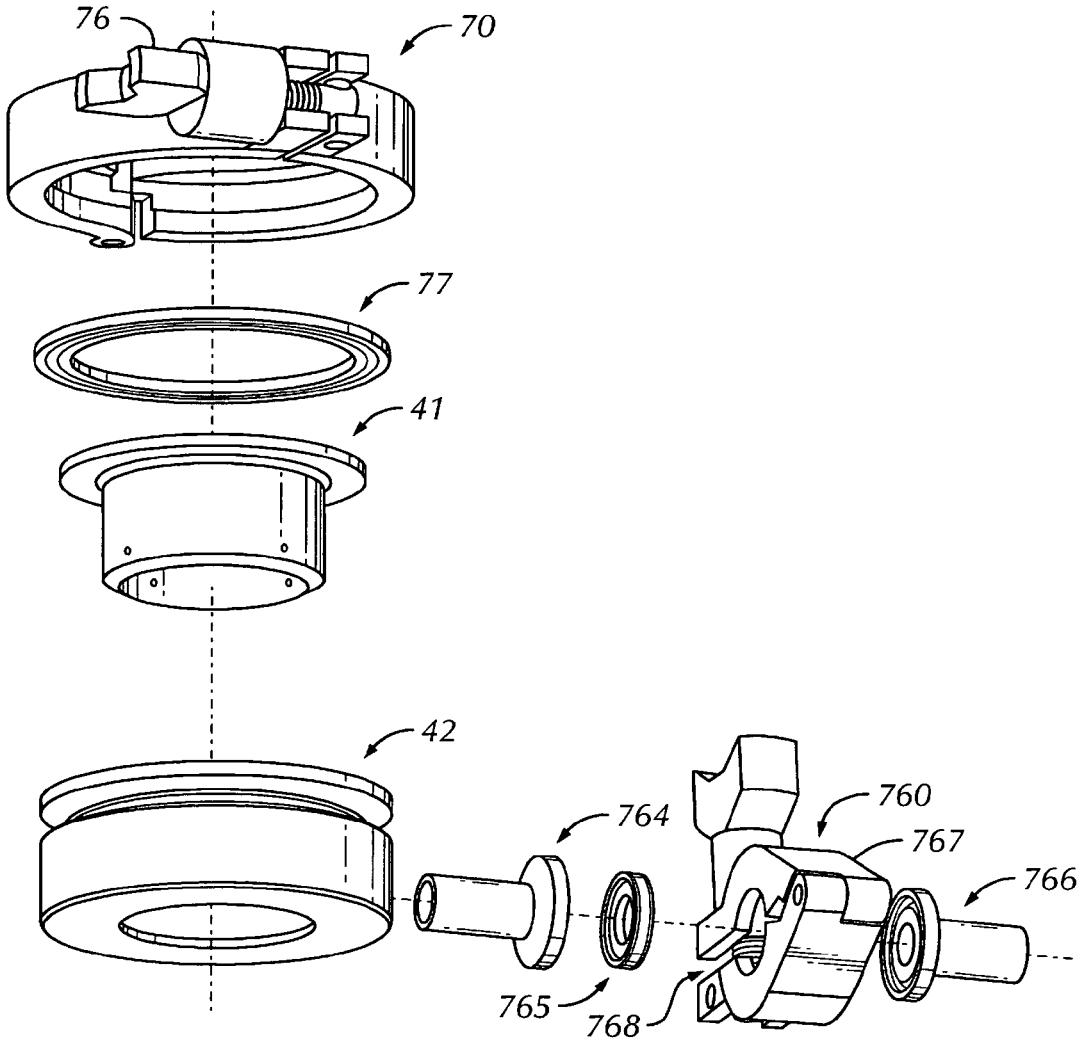
FIG. 6 is an exploded view of a nozzle attachment according to an embodiment of the invention.

In this non-limiting illustration, ferrules 764 and 766 are clamped using a tightening mechanism 760 using a sealing gasket 765. As illustrated in more detail in FIG. 6, for example, the ferrules 764 and 766 can be clamped in a bore 768 provided through a connecting body 767 integrally associated with another wing nut tightening mechanism 760 using sealing gasket 765.

Referring to FIG. 4 again, this provides a reliable system for feeding pressurized gas 301 into an inlet port 300 extending through the tightening mechanism 760 that feeds into the upper passageway 43 of the nozzle attachment 10. From there, the pressurized gas flows into lower passageway 44 of the nozzle attachment 10. The nozzle attachment 10 can be readily assembled and dismantled for cleaning and inspection. One of the ferrules 764 has one of its axial ends held, such as by welding, press-fitting, molding and so forth, in a recess provided in the outer nozzle attachment component 42 in an essentially air-tight manner, while the other opposite end is releasably mounted in a recess in the wing nut tightening mechanism 760.

Figure 5:
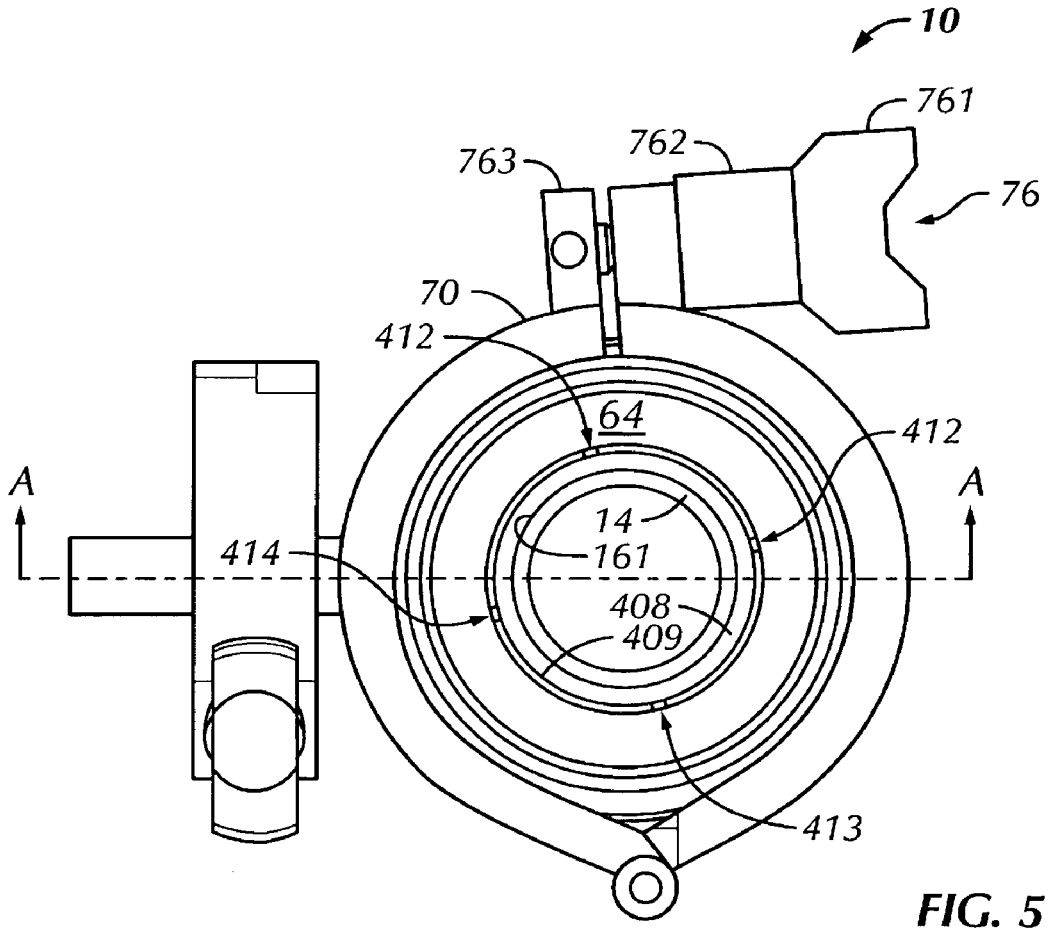
FIG. 5 is a top view of a nozzle attachment according to an embodiment of the invention including a top partial view of a discharge end of a separate dispenser nozzle to which the nozzle attachment is attached, taken along section B—B indicated in FIG. 2.

Referring to FIG. 5, the retainer 70 is preferably a quick connect and disconnect device, e.g., a hinged tri-clamp construction operable without the use of a tool and herein includes threaded fasteners comprising a wing nut tightening mechanism 76. The wing nut mechanism 76 basically is a winged threaded bolt 761 that is screwed through a threaded nut 762 and a threaded bore in a hinge arm 763, which permits the retainer clamp 70 to be easily tightened and loosened by hand. The retainer can also include a turn lock in place retainer feature (not shown), e.g., about a 30 degree turn lock in place retainer feature. Other quick connection and disconnect retention mechanisms also could be used that provide similar or comparable functionality or result.

Figure 7:
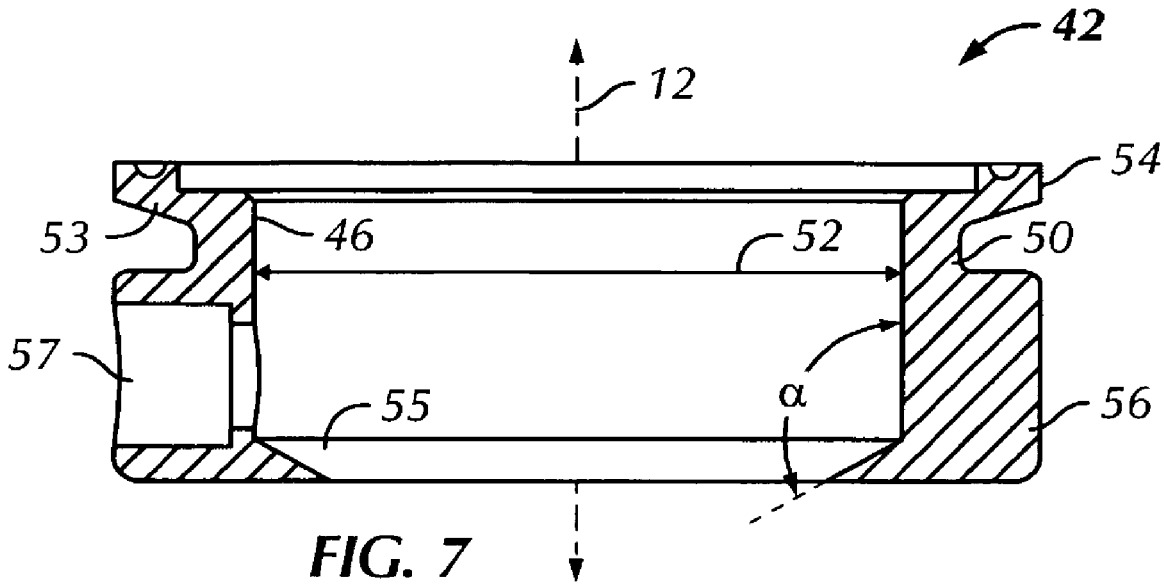
FIG. 7 is a cross-sectional view of an outer nozzle attachment component of the nozzle attachment according to an embodiment of the invention.
Figure 8:
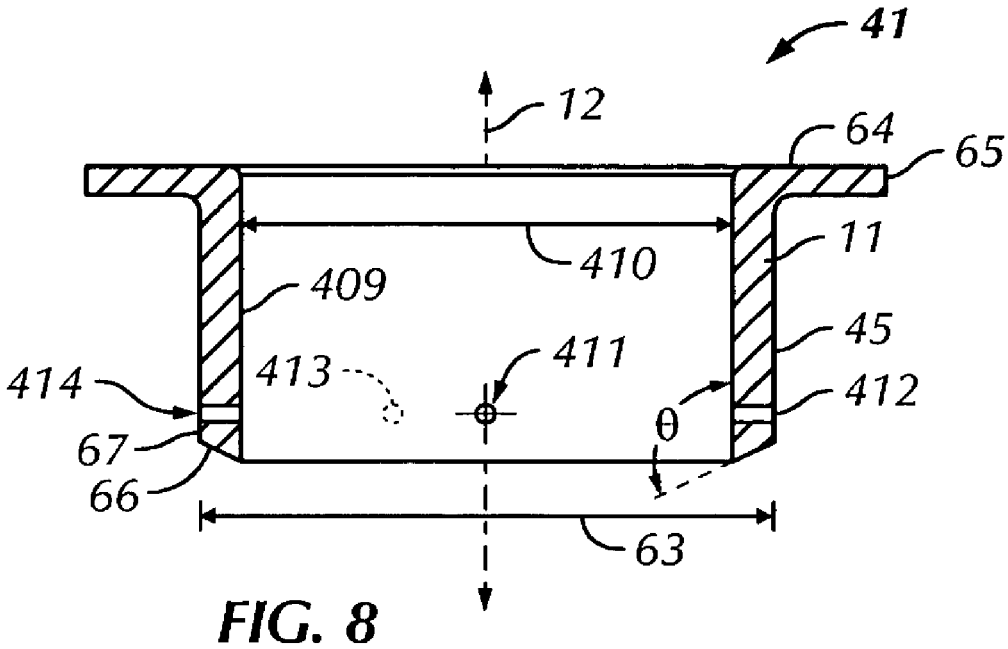
FIG. 8 is a cross-sectional view of an inner nozzle attachment component of the nozzle attachment according to an embodiment of the invention.

Referring again to FIG. 6, the exploded view shows in more clarity a retainer gasket 77 used in combination with retainer 70 as indicated in FIG. 4. The retainer gasket 77 has an inside diameter that is larger than the outer diameter of the inner nozzle attachment component 41. The outer diameter 63 of the inner nozzle attachment component 41 is indicated in FIG. 8. As can be seen in FIG. 7, the outer diameter 63 of inner nozzle attachment component 41 is similar in dimension to an upper flange surface 421 on the outer nozzle attachment component 42, upon which the inner nozzle attachment 41 is sealingly positionable for installation on the nozzle 15.

As shown in FIG. 7, the outer nozzle attachment component 42 includes a cylindrical body portion 50 having an inner surface 46 with an inner diameter 52. It also has the flanged surface 53 at one axial end 54 thereof and an inward-facing beveled surface 55 at the other axial end 56 thereof. It also includes a gas inlet 57 adapted to receive pressurized gas through the cylindrical portion 50.

As shown in FIG. 8, the inner nozzle attachment component 41 includes a cylindrical body portion 61 having an outer surface 45 with an outer radial diameter 63 that is smaller than the inner radial diameter 52 of the outer nozzle attachment component 42. Inner nozzle attachment component 41 also has a collar 64 extending radially outward from the cylindrical portion 61 at one axial end 65 thereof, and an outward-facing beveled surface 66 at the other axial end 67 thereof.

For the purpose of quick connect assembly and disassembly without the use of tools, the inner nozzle attachment component 41 is adapted to be concentrically nested within the outer nozzle attachment component 42 by positioning of its collar 64 on the flanged surface 53 of the outer nozzle attachment component 42. The inner nozzle attachment component 41 has an inner radial surface 409 which is sized to slip over and concentrically surround the outer surface 161 of the discharge end 14 of nozzle 15. The gap size provided between the outer nozzle surface 161 is not particularly limited as long as the gas emitted from discharge opening 47 can be maintained at sufficient force to shear tailings off the end of the dispenser nozzle. For example, the gap (not shown) can be about 0.1 to about 0.2 inch, or some other positive value.

When the inner and outer nozzle components 41 and 42 are nested, not only is an internal upper gas passageway 43 is defined between the axially extending side surfaces of the components that encompasses the full circumference of the attachment 10, but also an inwardly and downwardly angled lower gas passageway 44 is defined between the inner and outer nozzle attachment components 41 and 42. The lower gas passageway 44 is in fluid communication with the upper gas passageway 43, which together form a continuous single gas passageway 440 between the gas inlet 57 and the discharge opening 47.

As seen in FIG. 4, the beveled surface 55 of the outer nozzle attachment component 42 and beveled surface 66 the inner nozzle attachment component 41 define an angled intervening gas passageway 44 when the nozzle components are nested together. As indicated in FIG. 7, the lower beveled surface of 55 the outer nozzle attachment component 42 preferably makes an angle α (alpha) with the axial direction 12 of the dispenser system which is greater than 90 degrees and less than 180 degrees, and preferably is about 125 to about 160 degrees, and more preferably is about 135 to about 150 degrees (absolute value). As indicated in FIG. 8, the lower beveled surface of 66 the inner nozzle attachment component 41 preferably makes an angle θ (theta) with the axial direction 12 of the dispenser system which is greater than 90 degrees and less than 180 degrees, and preferably is about 125 to about 160 degrees, and more preferably is about 135 to about 150 degrees (absolute value). The nozzle attachment components 41 and 42 can be designed to provide absolute angle values for angles α and θ that are approximately the same such that passageway 44 has generally parallel facing walls. The angles α and θ also can be different at least to the extent the inner facing walls defining passageway 44 in the nozzle attachment 10 do not physically converge. For example, nozzle attachment components 41 and 42 can be designed to provide absolute angle values for angles α and θ that create a nozzle-shaped passageway such that the facing walls of passageway 44 taper down towards each other in the direction of the discharge opening 47. Either way, this is desired so that the gas stream 49 exiting the nozzle attachment 10 has an angle of attack on the nozzle discharge end 14 that is directed both radially inward and axially downward. In this way, shearing force action will be applied by the emitted gas stream 49 to any residual material clinging to the discharge end 14 after the most recent dispensing operation. Therefore, uniform amounts of fluid product can be packaged in each container.

Also, the emitted gas stream 49 also will incorporate a downward force to help clean/remove any residual material that may curl or wrap around the outside diameter of the valve. These "blow off" forces can be applied to residual material clinging, dripping, drooling, curling, sticking, or otherwise remaining as a tailing on the discharge end 14 of the nozzle 15 after a prior dispensing procedure ensures all product dispensed per dispensing cycle gets packaged in that cycle, and that uniform amounts of food are dispensed in each dispensing cycle.

In one embodiment, an external supply 30 ("$S_2$") of sanitary or sterile gas under pressure is used to feed pressurized gas 301 into the nozzle attachment 10. A valve 29 ("$V_2$") can be controlled automatically via controller 28. For example, a microprocessor-based controller 28 can be used to synchronize the timing of the movement of the valve head 11 in the dispenser 100 and the release of the pressurized gas 49 through the blow off nozzle attachment in-between filling cycles. The controller 28 also can be used to time the duration of release of pressurized gas 301 into the nozzle attachment 10. The sanitary or sterile gas that can be used includes, for example, inert gas, heated air, nitrogen, or steam, and so forth. It will be appreciated that the pressurized gas 300 does not necessarily have to be sanitary or sterile gas for all applications in which the nozzle attachment 10 can be used in conjunction with a dispensing head or filling valve, especially in many applications not involving foods. In one non-limiting embodiment, about a 0.5 to 1.0 second, more particularly about a 0.6 to 0.8 second, blast of air, at about 50 to 100 psig, more particularly about 70 to 80 psig, is emitted from the blow off nozzle attachment 10 to provide a blow off force at the discharge end 14 of the nozzle 15. The blow off air can be performed as a rapid series of pulses or as a single blast for each residue elimination procedure.

After performing the blow off procedure using nozzle attachment 10, a weight sensing means (not shown) can be used to measure the specific amount of fluid dispensed in the most recent dispensing and nozzle cleaning cycle, and that information can be transmitted to controller 28 via communication line 31. The controller 28 can determine if the dispensed amount is within predefined tolerances, before initiating the next dispensing cycle.

The dispensers adapted with the nozzle attachment described herein can be conveniently and efficiently used to fill a plurality of containers in sequence, or otherwise dispense uniform amounts of fluid in sequence.

As will be appreciated, while the outer and inner nozzle attachment components 42 and 41, respectively, are illustrated in this example as including cylindrical body portions, their body portions are not limited to that geometry. They are hollow body portions that can be virtually any geometric shape in cross-section, e.g., circular, square, octagonal, and so forth, as long as they are dimensioned with diameters meeting the requirements of this invention and providing an adequate central opening in the inner nozzle attachment component to permit the valve head to be extended through it in an unobstructed manner. For convenience sake, the inner and outer body portions generally will be used having the same type of geometry other than the respective radial dimensions thereof. Regular geometric shapes are preferred, and cylindrical shapes are more preferred, although not required.

Referring again to FIG. 8, in another embodiment, at least one anti-build port, illustrated as port 411, is included in the inner nozzle attachment component 41. Referring again to FIGS. 4 and 5, the gas introduced into passageway 43, which is best seen in FIG. 4, will be diverted and flow through ports 411, 412, 413, and 414 into a gap 408 that is present between the inner surface 409 of the inner nozzle attachment component 41 and the outer surface 161 of the discharge end 14 of nozzle 15, which is best seen in FIG. 5. This is performed in a manner effective that a positive pressure also is created in the gap 408, which will prevent or remove any creep up of tailings into that gap. In one preferred embodiment, multiple anti-build ports 411, 412, 413 and 414, which may have radial locations as generally indicated in FIG. 5, are provided at substantially equidistant locations around the circumference of inner nozzle attachment component 41. For example, the four ports 411, 412, 413 and 414 can be spaced approximately 90 degrees apart from one another around the circumference of inner nozzle attachment component 41. The port 411 alternatively could be a narrow slot that extends around at least a part of the circumference of the inner nozzle attachment component 41. The air gaps created by the anti-build ports will be sized and located in a manner effective prevent or remove any creep up of tailings into the gap between the inner surface 409 of the inner nozzle attachment component 41 and the outer surface 161 of the discharge end 14 of nozzle 15, but without causing a gas pressure loss in primary passageways 43 and 44 between inner and outer nozzle components 41 and 42 that would not undermine the herein-described drip-removal function associated with those features.

The nozzle attachment of the present invention has many advantages and benefits. The nozzle attachment can be readily detached from a filling valve nozzle. Herein, the term filling valve nozzle is used to be generic to the entire dispensing head such as illustrated in FIG. 1 or to only the nozzle portion of the filling head. It can be easily and fully dismantled to permit full inspection and cleaning, i.e., the nozzle attachment of the present invention will support manual cleaning operations. The inspection is done to check for visible contamination or wear, performing microbial swab tests, and so forth.

No tools are needed to assemble or dismantle (disassemble) the nozzle attachment part, as this can be done fully by hand in a "tool-less manner." All the internal surfaces and parts of the nozzle attachment can be inspected after disassembly of the component. The nozzle attachment also could be used in a clean-out-of-place mode where the part is dismantled substantially but not completely during inspection and cleaning procedures, depending on where the cleaning concerns are the greatest with respect to the part. For example, it may not be necessary to fully dismantle the wing-nut tightening parts for cleaning procedures used in some in applications, such as some non-food processing applications.

The nozzle attachment has no grooves, hidden surfaces, or recesses in which food particles might be entrapped and harbored to create a potential contamination risk. The nozzle attachment also can be used in modified atmosphere packaging (MAP) applications in high micro environments in connection with dispensing liquid or otherwise flowable product into packages to eliminate oxygen from head space and provide shelf stable products.

The nozzle attachment is particularly well-suited for food processing operations in which flowable food is being intermittently dispensed from a dispenser in uniform amounts. Examples of such foods that can be processed in a flowable state, include, for example, process cheese, dairy cream, mayonnaise, meats (e.g., beef, pork, poultry, or combinations thereof, liquid eggs, fruit-containing materials or beverages, peanut butter, and so forth. In one embodiment, the nozzle attachment addresses the weight control and dripping problem associated with prior fluid-form food dispensers by use of a timed sanitary air blow upon closure of a filling valve, around the entire shear surface area, to pulse the residual fluid into a primary filled package. Gas flow is balanced and aimed downward to disallow lateral blow off concerns.

The nozzle attachment of this invention is dairy, meat, or poultry compatible. The nozzle attachment of this invention can be used on most standard sanitary filling valves, and it can be interchanged between filling valves of the same size. The nozzle attachment of this invention can be used in food processing applications as a clean-out-of-place or manually cleanable part. It has no hidden passageways, which permits full inspection and cleaning. The nozzle attachment can be used in conjunction with the most rapid fill and low tolerance weight operations because it does not adversely affect the weight operation. The nozzle attachment can be used to remove residual material adhering to the end of the valve as well as provide gas flush capabilities for modified atmosphere packaging ("MAP") for all the benefits gained with reduced oxygen levels. In an alternative embodiment, the nozzle attachment also permits the gas blow system to be directly connected to a Clean-In-Place (CIP) system.

In one non-limiting example, a sanitary design of the nozzle attachment can be provided by use of stainless steel for all parts of the nozzle attachment. For example, stainless steel can be used for all parts of the nozzle attachment. Alternatively, the various nozzle attachment parts also can be made of other suitable materials that can be shaped into the applicable configurations, such as plastic materials, ceramic materials, and so forth, and, if desired or necessary, can be maintained in a sanitary condition. The same or different types of such materials can be used for the various parts of a given nozzle attachment.

In addition, the wetted parts of the dispenser, including, for example, the valve stem, valve head, and valve body, also can be made out of stainless steel. Stainless steel could be used for the yoke, actuator cylinder, and other non-wetted parts of the fluid dispenser, although the filling valve construction is not limited thereto. For example, the valve head, and so forth, alternatively could be a fluoropolymer construction, or a fluoropolymer-coated metal construction, or other material that is essentially inert and stable in the filling environment. The valve head also could include a fluoropolymeric or EPDM sealing ring, and the like, retained in an integral circumferential groove to provide the valve seat.

It will be understood that the teachings of the present invention are readily adaptable to many types of fluid dispensers that intermittently dispense liquids other than those specifically shown or identified herein. For example, the nozzle attachment could be used with nozzled dispensers used for other types of flowable viscous materials, such as molten polymeric compositions, plastic compositions, hot melt adhesives, and so forth.

While the invention has been particularly described with specific reference to particular process and product embodiments, it will be appreciated that various alterations, modifications and adaptions may be based on the present disclosure, and are intended to be within the spirit and scope of the present invention as defined by the following claims.

What is claimed is:

1. A nozzle attachment for removing residual material from the discharge end of a nozzle and for quick attachment and detachment from the nozzle, the attachment comprising:

an attachment assembly comprising components which are separable for cleaning;

an internal gas passageway in the attachment assembly between adjacent assembled components thereof and having an inlet to receive an incoming gas stream;

a discharge end on the attachment assembly to emit a gas stream from the internal gas passageway in a direction angled inwardly and downwardly relative to the discharge end of the nozzle to remove residual material from the nozzle; and a clamping retainer for clamping onto the nozzle, wherein the clamping retainer comprises a split ring and manual operable threaded members to tighten the split ring about the nozzle, and wherein the clamping retainer being operable manually without the use of a tool to connect and disconnect the nozzle attachment from the nozzle.

2. A nozzle attachment in accordance with claim 1, wherein the attachment assembly components are nested and axially separable from one another without the use of a tool and dismantleable for inspection and cleaning of each nested component.

3. A nozzle attachment in accordance with claim 1, wherein the manual operable threaded members comprise wing nuts.

4. A nozzle attachment in accordance with claim 1, wherein the clamping retainer clamps onto a clamp attaching portion on the nozzle.

5. A nozzle attachment in accordance with claim 4, wherein the clamping retainer is provided with substantially annular surfaces for cooperating with the annular clamp attaching portion on the dispensing nozzle.

6. A nozzle attachment in accordance with claim 1, further comprising a quick connect and disconnect device for detachably connecting an air inlet line to the nozzle attachment.

7. A nozzle attachment for attachment to a dispensing nozzle to deliver a discharge gas stream across a face of a discharge nozzle to remove residual material therefrom comprising:

a retainer on the nozzle attachment for releasably attaching to a nozzle;

an outer nozzle component in the attachment device;

an inner nozzle component nested in the outer nozzle component and cooperating therewith to define a gas passageway therebetween and being separable in an axial direction therefrom for cleaning;

the inner and outer nozzle components being mounted by the retainer on the nozzle and being axially separable from one another for cleaning of the inner and outer nozzle components; and inclined, spaced discharge surfaces at discharge ends of the nested inner and outer components to direct inclined inwardly and downwardly to create a discharging gas and a shearing force on the residue at the discharge end of the nozzle to remove residual material from the nozzle.

8. A nozzle attachment in accordance with claim 7, wherein the retainer comprises:

a clamp for clamping for detachably connecting the nozzle attachment to the nozzle.

9. A nozzle attachment in accordance with claim 7, wherein the retainer having a quick connect and disconnect device for detachably attaching the nozzle attachment to the nozzle to facilitate attachment and removal of the nozzle attachment for cleaning.

10. A nozzle attachment in accordance with claim 9, further comprising:

a quick connect and disconnect device for detachably connecting an air inlet line to the nozzle attachment.

11. A method of providing and cleaning a nozzle attachment for removing residual material from a dispensing nozzle comprising:

providing a nozzle attachment having an air inlet to receive pressurized air, wherein the nozzle attachment comprises nested inner and outer components which are separable in an axial direction without the use of a tool for cleaning of the components, and wherein the nested components define therebetween an internal gas passageway for gas to flow through the nozzle attachment and a discharge for discharging gas to create shear forces to remove residual material from the nozzle;

encircling the nozzle with a clamping device on the nozzle attachment device;

manually operating a quick connect and disconnect device to attach the nozzle attachment to the nozzle;

dispensing material through the nozzle and flowing gas through the gas internal passageways and discharging gas to create the shear forces to remove residual material from the nozzle; and manually operating the quick connect and disconnect to detach the nozzle attachment from the nozzle for cleaning.

12. A nozzle attachment for removing residual material retained on the dispensing nozzle of a fluid dispenser, comprising (a) a retainer adapted to releasably attach the nozzle attachment to a dispensing nozzle, and (b) a pair of annular nozzle attachment components that are separable in an axial direction and which define, when nested together, an intervening space provided between the nozzle attachment components which is operable as a gas passageway into which pressurized gaseous fluid can be introduced and directed to a discharge opening provided at a lower axial end of the nested nozzle attachment components, wherein the gas passageway is adapted to emit gas introduced into the gas passageway as a gas stream in a direction angled inwardly and downwardly relative to a discharge end of the dispensing nozzle effective to create a shearing force at the discharge end of the nozzle that dislodges and blows off any residual material clinging to the discharge end after a prior dispensing operation or cycle.

13. The nozzle attachment according to claim 12, wherein the pair of annular nozzle attachment components comprise:

i) an outer nozzle attachment component comprising a first hollow-bodied portion having an inner surface with an inner diameter, and a flanged surface at one axial end thereof and an inward-facing beveled surface at the other axial end thereof, and further including a gas inlet adapted to receive pressurized gas through the first hollow-bodied portion;

ii) an inner nozzle attachment component including a second hollow-bodied portion having an outer surface with an outer diameter that is smaller than the inner diameter of the outer nozzle attachment component, and a collar extending radially outward at one axial end and an outward-facing beveled surface at the other axial end thereof, wherein the inner nozzle attachment component being adapted to be nested within the outer nozzle attachment component by positioning of the collar of the inner nozzle attachment component on the flanged surface of the outer nozzle attachment component effective to define an upper gas passageway between the outer surface of the inner nozzle attachment component and the inner surface of the outer nozzle attachment component that is in communication with the gas inlet of the outer nozzle attachment component, and to define a lower gas passageway including a discharge opening between the outward-facing beveled surface of the inner nozzle attachment component and the inward-facing beveled surface of the outer nozzle attachment component wherein the lower gas passageway is in fluid communication with the upper gas passageway and is adapted to emit gas introduced into the nozzle attachment at an inward and downward angle relative to the discharge end of the nozzle to create a shearing force at the discharge end of the nozzle; and wherein the retainer is adapted to releasably retain the outer nozzle attachment component while the inner nozzle attachment component is nested therein, and concurrently provide releasable mechanical connectivity to the nozzle.

14. The nozzle attachment according to claim 13, wherein the first hollow-bodied portion is a first cylindrical portion, and the second hollow-bodied portion is a second cylindrical portion.

15. The nozzle attachment according to claim 13, wherein the outer nozzle attachment component comprises an upper flanged surface adapted to be sealingly engaged and held to a surface of the retainer.

16. The nozzle attachment according to claim 13, further comprising a ferrule releasably attachable to the gas inlet of the outer nozzle attachment component adapted to provide fluid communication between the gas inlet and an external source of pressurized fluid.

17. The nozzle attachment according to claim 13, wherein the outward-facing beveled surface of the inner nozzle attachment component and the inward-facing beveled surface of the outer nozzle attachment component are inclined at an absolute angle value of greater than 90 degrees and less than 180 degrees.

18. The nozzle attachment according to claim 13, wherein the outward-facing beveled surface of the inner nozzle attachment component and the inward-facing beveled surface of the outer nozzle attachment component are inclined at an absolute angle value of about 125 to about 160 degrees.

19. The nozzle attachment according to claim 13, wherein the retainer comprises a clamp including a wing nut operable to tighten or loosen the connection to a valve nozzle.

20. The nozzle attachment according to claim 13, wherein the discharge opening comprises a substantially continuous ringed opening adapted to encircle the nozzle.

21. A fluid dispenser for use in intermittent dispensing operations, comprising:

a dispenser body including a fluid inlet communicating with a fluid passageway;

a discharge nozzle having a discharge end from which fluid is dispensed;

a valve stem positioned within the fluid passageway adapted to be controllably moved vertically up and down within the fluid passageway by an actuator;

a valve head located in the discharge end of the discharge nozzle, wherein the valve head is positionable in a sealing relationship with interior walls of the fluid passageway in the discharge end of the nozzle during non-dispensing operational times, and adapted to be moved vertically downward by the valve stem out of sealing relationship with the fluid passageway in the discharge nozzle during dispensing operational times such that fluid fed into fluid passageway can pass by the valve head and exit from the discharge end of the nozzle;

a nozzle attachment attached to the nozzle, comprising (a) a retainer adapted to releasably attach the nozzle attachment to a dispensing nozzle, and (b) a pair of hollow-bodied nozzle attachment components that define, when nested together, an intervening space operable as a gas passageway into which pressurized gaseous fluid can be introduced and directed to a discharge opening provided at a lower axial end of the nested nozzle attachment components, wherein the gas passageway is adapted to emit gas introduced into the gas passageway as a gas stream in a direction angled inwardly and downwardly relative to a discharge end of the dispensing nozzle effective to create a shearing force at the discharge end of the nozzle that dislodges and blows off any residual material clinging to the discharge end after a prior dispensing operation or cycle.

22. The fluid dispenser according to claim 21, wherein the pair of nozzle attachment components comprise:

(a) an outer nozzle attachment component comprising a first hollow-bodied portion having an inner surface with an inner diameter, and a flanged surface at one axial end thereof and an inward-facing beveled surface at the other axial end thereof, and further including a gas inlet adapted to receive pressurized gas through the annulus portion;

(b) an inner nozzle attachment component including a second hollow-bodied portion having an outer surface with an outer diameter that is smaller than the inner diameter of the outer nozzle attachment component, and a collar extending radially outward at one axial end and an outward-facing beveled surface at the other axial end thereof, wherein the inner nozzle attachment component being adapted to be nested within the outer nozzle attachment component by positioning of the collar of the inner nozzle attachment component on the flanged surface of the outer nozzle attachment component effective to define an upper gas passageway between the outer surface of the inner nozzle attachment component and the inner surface of the outer nozzle attachment component that is in communication with the gas inlet of the outer nozzle attachment component, and to define a lower gas passageway including a discharge opening between the outward-facing beveled surface of the inner nozzle attachment component and the inward-facing beveled surface of the outer nozzle attachment component wherein the lower gas passageway is in fluid communication with the upper gas passageway and is adapted to emit gas introduced into the nozzle attachment at an inward and downward angle to create a shearing force at the discharge end of the nozzle; and wherein the retainer is adapted to releasably hold the outer nozzle attachment component while the inner nozzle attachment component is nested therein, and concurrently provide releasable mechanical connectivity to the nozzle.

23. The fluid dispenser according to claim 22, wherein the valve head has a truncated cone shape having increasing diameter nearer the discharge end of the nozzle and smaller diameter further from the discharge end of the nozzle, wherein the valve head has a first diameter adapted to seal with the passageway to stop fluid flow out of the discharge end of the nozzle when the valve stem is sufficiently upraised, and a second diameter, smaller than the first diameter, in which a gap is provided between the second diameter and passageway when the valve stem is sufficiently lowered to permit flow of fluid.

24. The fluid dispenser according to claim 23, wherein the first hollow-bodied portion is a first cylindrical portion, and the second hollow-bodied portion is a second cylindrical portion.

25. The fluid dispenser according to claim 23, wherein the outer nozzle attachment component comprises an upper flanged surface adapted to be sealingly engaged and held to a surface of the retainer.

26. The fluid dispenser according to claim 23, further comprising a ferrule releasably attachable to the gas inlet of the outer nozzle attachment component adapted to provide fluid communication between the gas inlet and an external source of pressurized fluid.

27. The fluid dispenser according to claim 23, wherein the outward-facing beveled surface of the inner nozzle attachment component and the inward-facing beveled surface of the outer nozzle attachment component are inclined at an absolute angle value of greater 90 degrees and less than 180 degrees.

28. The fluid dispenser according to claim 23, wherein the outward-facing beveled surface of the inner nozzle attachment component and the inward-facing beveled surface of the outer nozzle attachment component are inclined at an absolute angle value of about 125 to about 160 degrees.

29. The fluid dispenser according to claim 23, wherein the retainer comprises a clamp including a wing nut operable to tighten or loosen the connection to a valve nozzle.

30. The fluid dispenser according to claim 23, wherein the discharge opening comprises a substantially continuous ringed opening adapted to encircle the nozzle.

31. A fluid dispenser for use in intermittent dispensing operations, comprising:

a dispenser body including a fluid inlet communicating with a fluid passageway, and a discharge nozzle having a discharge end from which fluid is dispensed;

a valve stem positioned within the fluid passageway adapted to be controllably moved vertically up and down within the fluid passageway by an actuator;

a valve head located in the discharge end of the discharge nozzle, wherein the valve head has a truncated cone shape having increasing diameter axially nearer the discharge end of the nozzle and smaller diameter axially further from the discharge end of the nozzle, wherein the valve head has a first diameter adapted to seal with the passageway to stop fluid flow out of the discharge end of the nozzle when the valve stem is sufficiently vertically upraised, and a second diameter, smaller than the first diameter, in which a gap is provided between the second diameter and passageway when the valve stem is sufficiently vertically lowered to permit flow of fluid out of the discharge end of the nozzle;

a nozzle attachment releasably attached to the nozzle, and concentrically surrounding the nozzle, wherein the nozzle attachment including an internal gas passageway for receiving pressurized gas and a discharge opening in fluid communication with the gas passageway adapted to direct the pressurized gas at an inward and downward angle relative to the discharge end of the nozzle.

32. A method for cleaning a discharge nozzle of a fluid dispenser, comprising:

1) providing a dispenser, including:

a dispenser body having a fluid inlet communicating with a fluid passageway, and a discharge nozzle having a discharge end from which fluid is dispensed;

a valve stem positioned within the fluid passageway adapted to be controllably moved vertically up and down within the fluid passageway by an actuator;

a valve head located in the discharge end of the discharge nozzle, wherein the valve head has a truncated cone shape having increasing diameter axially nearer the discharge end of the nozzle and smaller diameter axially further from the discharge end of the nozzle, wherein the valve head has a first diameter adapted to seal with the passageway to stop fluid flow out of the discharge end of the nozzle when the valve stem is sufficiently vertically upraised, and a second diameter, smaller than the first diameter, in which a gap is provided between the second diameter and passageway when the valve stem is sufficiently vertically lowered to permit flow of fluid out of the discharge end of the nozzle;

a nozzle attachment releasably attached to the nozzle, and concentrically surrounding the nozzle, wherein the nozzle attachment comprises (a) a retainer adapted to releasably attach the nozzle attachment to a dispensing nozzle, and (b) a pair of hollow-bodied nozzle attachment components that define, when nested together, an intervening space operable as a gas passageway into which pressurized gaseous fluid can be introduced and directed to a discharge opening provided at a lower axial end of the nested nozzle attachment components, wherein the gas passageway is adapted to emit gas introduced into the gas passageway as a gas stream in a direction inwardly and downwardly relative to a discharge end of the dispensing nozzle;

2) dispensing fluid from the dispenser via the discharge end of the nozzle;

3) removing residual fluid from the discharge end of the nozzle by introducing pressurized air into the gas passageway of the nozzle attachment effective to be emitted from the discharge opening of the nozzle attachment and creates a sufficient shearing force at the discharge end of the nozzle to dislodge the residual fluid from the discharge end of the nozzle.

33. A nozzle attachment for removing residual material from the discharge end of a nozzle and for quick attachment and detachment from the nozzle, the attachment comprising:

an attachment assembly of components being separable for cleaning;

an internal gas passageway in the attachment assembly between adjacent assembled components thereof and having an inlet to receive an incoming gas stream;

a discharge end on the attachment assembly to emit a gas stream from the internal gas passageway in a direction angled inwardly and downwardly relative to the discharge end of the nozzle to remove residual material from the nozzle; and a clamping retainer for clamping onto a clamp attaching portion of the nozzle, wherein the clamping retainer is provided with substantially annular surfaces for cooperating with the annular clamp attaching portion on the dispensing nozzle, and wherein the clamping retainer being operable manually without the use of a tool to connect and disconnect the nozzle attachment from the nozzle.

* * * * *

UNITED STATES PATENT AND TRADEMARK OFFICE

CERTIFICATE OF CORRECTION

PATENT NO. : 6,957,781 B2
DATED : October 25, 2005
INVENTOR(S) : Gowens et al.

It is certified that error appears in the above-identified patent and that said Letters Patent is hereby corrected as shown below:

Column 16,
Line 25, after "greater", insert -- than --.

Signed and Sealed this

Fourth Day of April, 2006

JON W. DUDAS
*Director of the United States Patent and Trademark Office*